US005580009A

United States Patent [19]

Kennedy

[11] Patent Number: 5,580,009

[45] Date of Patent: Dec. 3, 1996

[54] SOLID WASTE COMMINUTOR

[76] Inventor: Joseph Kennedy, 186 Congress Rd., Emerson, N.J. 07630

[21] Appl. No.: 341,631

[22] Filed: Nov. 17, 1994

[51] Int. Cl.[6] ..... B02C 18/06; B02C 18/18

[52] U.S. Cl. ..... 241/236; 241/285.2

[58] Field of Search ..... 241/236, 285.3, 241/285.2

[56] References Cited

U.S. PATENT DOCUMENTS

| | | | |
|---|---|---|---|
| 4,630,781 | 12/1986 | Brown, Jr. et al. | 241/159 |
| 5,169,075 | 12/1992 | Galanty | 241/46.04 |
| 5,186,401 | 2/1993 | Herdman et al. | 241/46.01 |
| 5,395,057 | 3/1995 | Williams, Jr. et al. | 241/36 |
| 5,484,112 | 1/1996 | Koenig | 241/236 |

FOREIGN PATENT DOCUMENTS

| | | | |
|---|---|---|---|
| 4315671 | 11/1994 | Germany | 241/236 |

*Primary Examiner*—John M. Husar

[57] ABSTRACT

A solid waste comminutor includes removable side frames enclosing a cutting chamber. Upper and lower plates key the machine frames together when the side frames are removed to expose the rotor assembly. A holding fixture is installed under the rotor spacers to support the weight of the rotors with the side frames removed. The ends of the rotor shaft engage idler and drive pintles under control of a hydraulic system which retracts the pintle assemblies leaving the rotors resting on the holding fixture so it can be slid out free of the machine and replaced with a spare rotor. Thus it is possible to gain access to the wearing parts of the comminutor without dismantling the machine frame, hoppers or drive train. This saves considerable time and expense

6 Claims, 4 Drawing Sheets

SOLID WASTE COMMINUTOR

BACKGROUND OF THE INVENTION

This invention relates to solid or liquid-solid waste comminuting apparatus and particularly to a method and apparatus including means to readily replace bearing, seals, cutters and spacers due to wear on the comminuting apparatus.

The present technique of comminuting waste material into the nip of counter rotating cutters is disclosed in the prior art such as U.S. Pat. No. 4,630,781 to Brown, et al. Little attention however has been given to the replacement of bearings, seals, cutters, and spacers due to wear. The cutter edges tend to round thereby reducing the shear or scissor action and causing heat and lost production time during replacement. Bearings and seals eventually become contaminated by waste leading to eventual bearing failure. Since bearings and seals are confined to a cartridge, bearings failure usually occurs shortly after a seal failure.

It is impractical to operate a shredder with duel cutters which result in diminishing productivity. Duel cutters increase power demand, because of increased frictional resistance causing more frequent stalling and reversing of the rotors to clear the jam. The particle size will also gradually increase in size. Bearing and gear life will shorten due to increase loading of these components.

The present day shredders depending on the size of the apparatus now require one to five days to replace rotors. Occasionally cutters are sharpened in place to save lost production, but this remedy is not satisfactory. It may result in a cutter unable to be factory sharpened and require a new cutter.

It is important to replace all rotating wearing parts on a machine quickly without dismantling the machine. The present art requires removal of hoppers and separation of the machine frame and drive mechanism to obtain access to the bearings, seals and rotor shaft assembly with cutters and spacers.

The time required for servicing is an important cost factor since down time reduces production and time intensive work increases labor costs. Bearing-seal cartridges and new cutter-spacers can generally be installed on small machines in 4–8 hours since the rotor assemblies are relatively light and can be manually installed. Servicing the rotor assemblies of large machines generally require the use of cranes or mobile fork lift trucks and takes several days.

On occasion, shredders expected to process a variety of products. A selected style of cutter on a rotor shaft may be satisfactory for some of these products but not for all of them. The ability to change rotor configuration quickly, to satisfy all of these products will be a decided advantage.

Other references of interest include U.S. Pat. Nos. 4,630,781; 3,690,572 and 5,169,075. None of these patents however include the unique features of this invention.

SUMMARY OF THE INVENTION

This invention relates to comminuting apparatus which comprises one or more rotors having a series of blades or spacers mounted thereon to shred solid waste or liquid borne solid waste. The comminuting apparatus comprises intermeshing grids which shred the material within a cutting chamber. In particular, this invention relates to a method and apparatus to substantially reduce maintenance time by permitting access to the wearing parts of the apparatus without dismantling the machine frames, hoppers or drive train.

In operation, the side frames which enclose the cutting chamber are removed and a holding fixture is installed beneath the rotor spacers to support the rotors. Rotors are preassembled in matched pairs with the cutter-spacer stack secured in grooved slots in the rotor shaft. The ends of the shaft are hexagonal in cross-section with a round pilot diameter to engage the idler and drive pintles which are bolted together.

The assemblies are moved hydraulically, or mechanically to engage or disengage the rotor shafts. With the holding fixture in place, the idler and drive pintles are retracted leaving the rotors on the holding fixture. The rotors can be removed and replaced with a new rotor. The bearings and other worn parts can also be readily replaced.

Accordingly, it is an object of this invention to provide a new and improved comminuting apparatus on which parts subject to wear can be readily replaced.

Another object of this invention is to provide a new and improved comminuting apparatus wherein the rotor and other parts can be readily replaced without dismantling the apparatus.

A further object of this invention is to provide a new and improved method to service comminuting apparatus in a ready and expeditious manner.

A more specific object of this invention is to provide a new and improved comminuting apparatus wherein the sides of the cutting chamber may be removed to permit the rotor shafts to rest on a holding fixture while the pintles on the rotor shafts are removed hydraulically from bearings to permit ease of replacement for the rotors, bearings, and other parts subject to wear.

DESCRIPTION OF THE DRAWINGS

The above and other objects of the invention may be more clearly seen when viewed in conjunction with the accompanying drawings wherein.

DETAILED DESCRIPTION OF THE INVENTION

Figure 1:
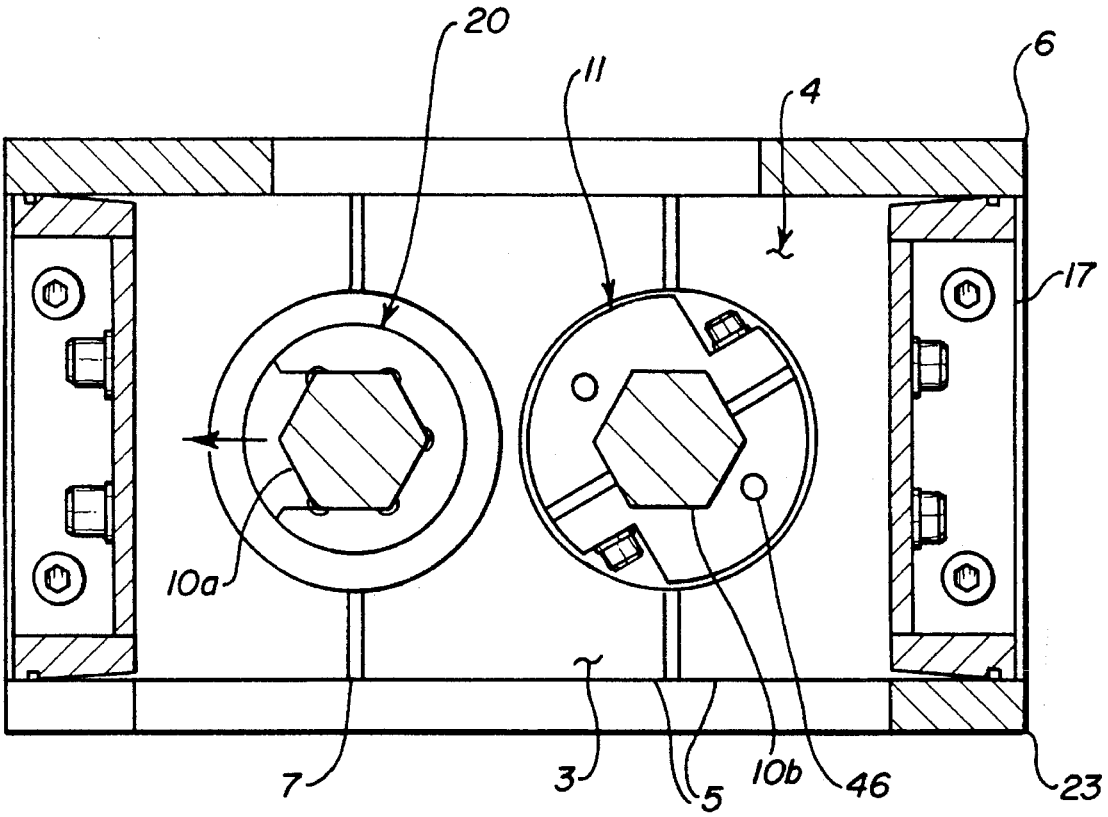
FIG. 1 is a view of the invention through the line 1—1 of FIG. 3 showing the split rotor collar and idler pintle.

Referring now to the drawings, the invention comprises a comminuting apparatus 30 which shreds solid waste in a cutting chamber 31. A gear motor 28 is coupled to rotor shafts 10*a* and *b* through a slide gear coupling 27 and pinion 9 and a reverse gear set 8. The driven pintles 15*a*, 15*b* are mounted in bearings 44 in bearing plate 22 at one end and in bearings 45 in bearing plate 21 at the other end. Drive pintles 16*a*, 16*b* are coupled to driven pintles 15*a*, 15*b* in the bearing plate 21 to be actuated thereby.

The ends 33*a–d* of the rotor shafts 10*a* and 10*b* are machined hexagonal with a round pilot diameter to engage, respectively, the idler pintles 20*a*, 20*b* and the drive pintles 16*a*, 16*b*. The idler pintles 20*a*, 20*b* are mounted in bearings 45 in the bearing plates 2. A hydraulic piston 26*a* drives the bearing plates 21 and 22 axially to lock or release the rotor shafts 10*a* and 10*b* in the apparatus 30. Hydraulic piston 26*b* drives bearing plate 21*b* also in an axial direction. The pistons 26*a* and 26*b* are connected to a manual pump 60 for actuation.

Each rotor shaft 10*a* and 10*b* includes a plurality of cutters 24 separated by spacers 25 and mounted on the shafts 10*a*, 10*b*. The shaft 10*a* has spacers 25 which cooperate with blades 24 on the opposing shaft 10*b* and vise versa. Heretofore, it was necessary to dismantle the machine frames, hoppers or drive train to gain access to the rotor assemblies or other parts needing replacement due to wear. During use, the cutters 24 wear and the bearings 29, 44 are eventually subject to failure due to seal failure.

Figure 2:
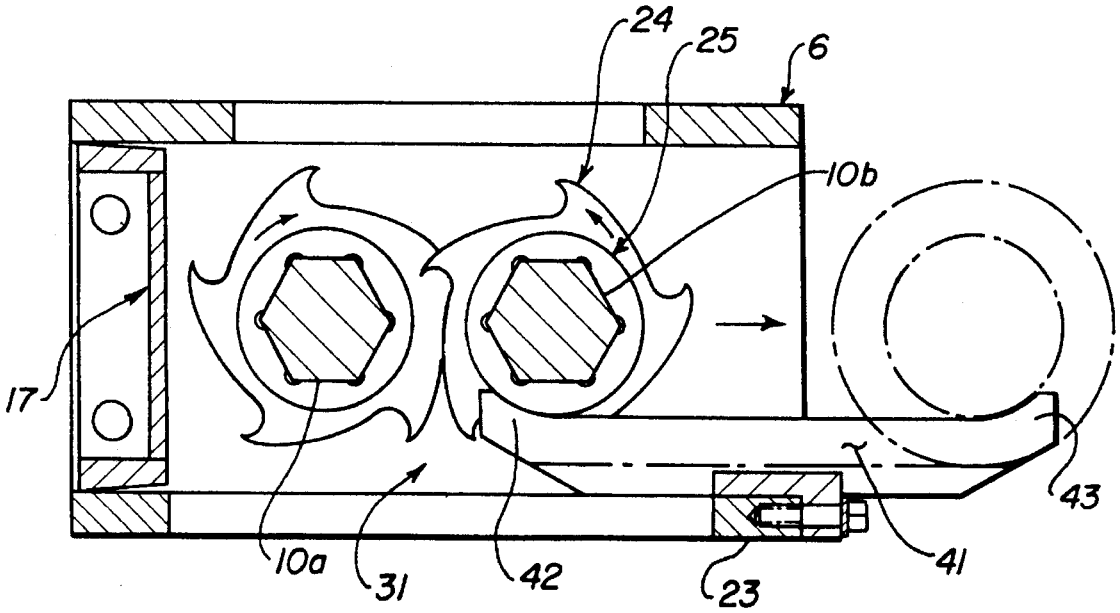
FIG. 2 is a view of the invention through the line 2—2 of FIG. 3 showing the rotor assembly supported by a holding fixture.
Figure 5:
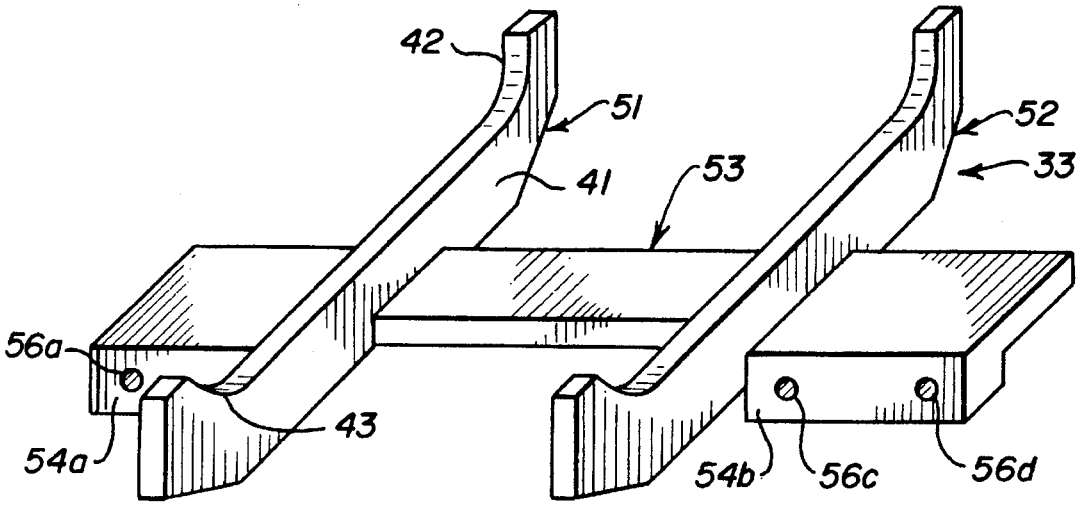
Figure 3:
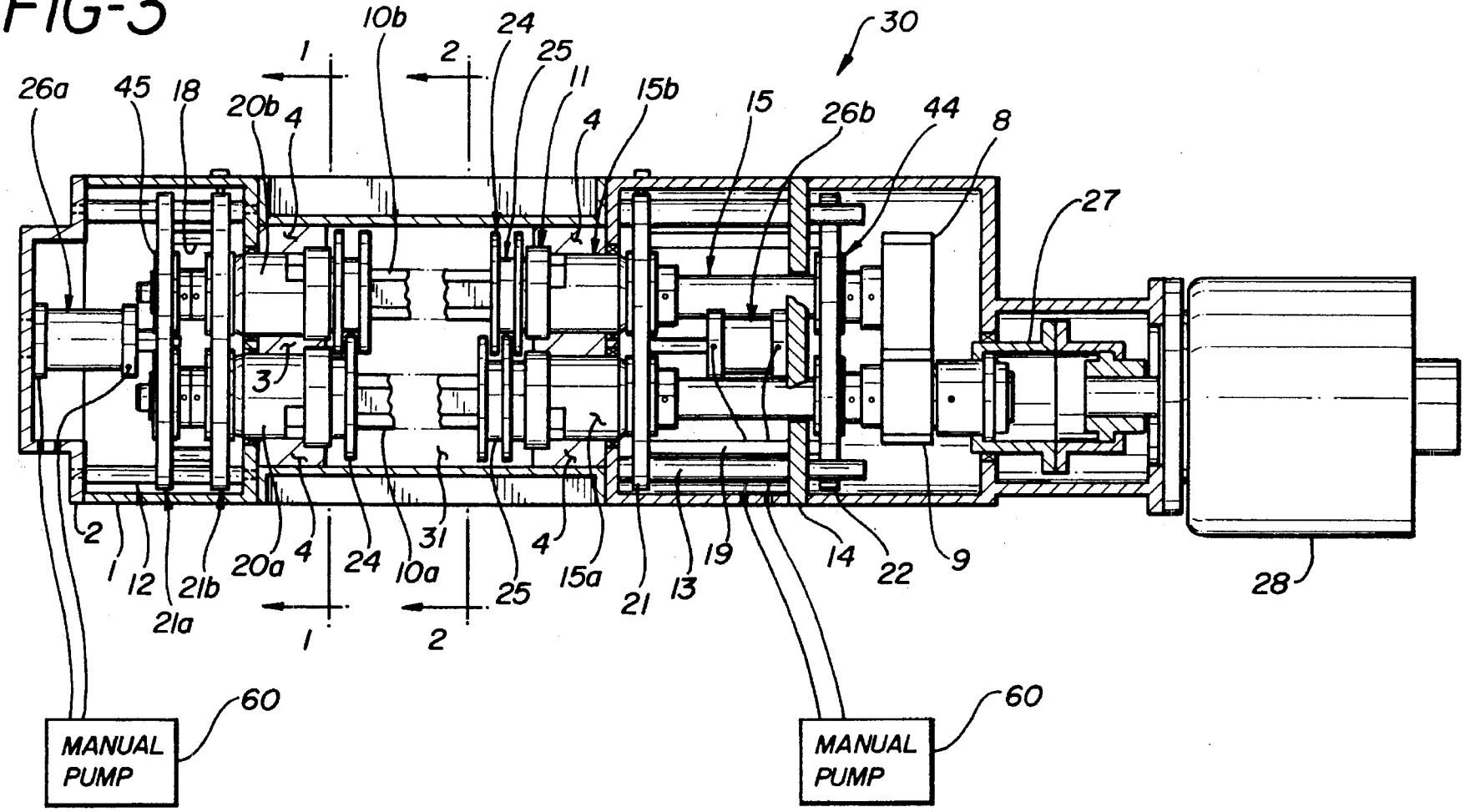
FIG. 3 is a cross-sectional view of the invention closed and operating with idler and drive pintles engaged the male hexagon drive ends of rotor shafts.
Figure 4:
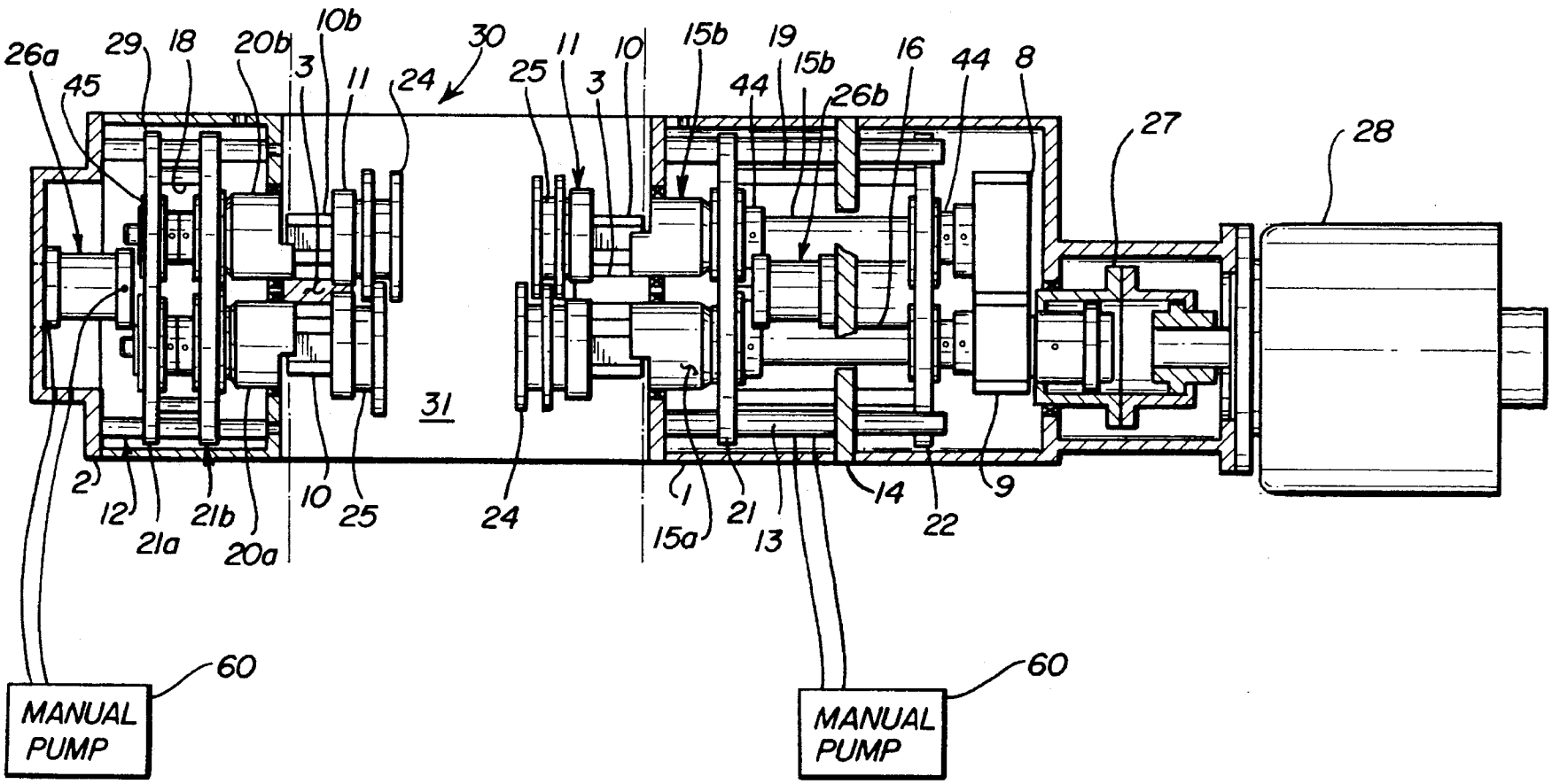
FIG. 4 is a cross-sectional view of the invention with the side panels and wear plates removed, and the idler and drive pintles retracted by hydraulic pistons, wherein the rotor assemblies are free to be removed from the machine, the seals are accessible for replacement and the drive is still engaged; and, FIG. 5 is a perspective view of the holding fixture which support the rotor assemblies.

Accordingly to practice the invention, the side panels 17 as shown in FIG. 2 that enclose the cutting chamber 31 are removed thereby exposing the rotor assembly. The apparatus 30 is still intact and held together by upper plate 6 and lower plate 23 that key the frame together. The hoppers and drive train are still in place but in the space occupied by the side frames 17, a holding fixture 35 is inserted under the rotor spacer 25 and supports the weight of each rotor assembly comprising the shaft 10*a*, 10*b* and the associated cutters 2–4 and spacers 24. The holding fixture 33 includes a pair of members 51, 52 comprising a main elongated body 41 which tapers upwardly at its ends 42, 43 to engage at one end 42,a spacer 25 on the rotor assembly. The members 51, 52 are joined by cross member 53 which includes downwardly extending portions 54*a*, 54*b* with aperture 56*a–c* for bolting to the frame where the side panel 17 was removed.

The rotors 10*a*, 10*b* can be preassembled in matched pairs for any given machine or a single rotor can be used. The cutter-spacer stack is locked between two split collars 11*a*, 11*b* that are secured in grooved slots machined into the particular shaft 10*a*, 10*b*, see FIG. 1. These slots prevent lateral movement of the collars 11*a*, 11*b*. Setscrews 46 in these collars 11*a*, 11*b* permit shifting of the stack of cutters-spacers laterally on the shaft 10*a*, 10*b* to attain proper clearances with the opposing rotor.

The idler and drive pintles 20 and 15 are supported in bearing plates 21, 22 that are bolted together. These assembles are linearly guided in guide pins 12 and 13 that are secured in the apparatus frame. Each assembly contains two bearings for each pintle. The assemblies are movable on the guide pins 12, 13 to engage or disengage the rotor shafts 10*a*, 10*b* either hydraulically or mechanically. The hydraulic system can engage or disengage the rotors (ie., rotor shafts 10*a*, 10*b*) simultaneously by use of a manual pump.

With the holding fixture 33 in place, the idler 20*a*, 20*b* and drive 16*a*, 16*b* pintles can be retracted leaving the rotors weight resting on the holding fixture 33, see FIG. 2. The rotors 10*a*, 10*b* then can be slid out free of the machine and replaced with a spare rotor. The entire procedure can be performed rapidly and inexpensively.

The idler pintle assembly is retracted within the machine frame. These idler pintles 20*a*, 20 bare bolted to the rotor 10 or 10*b* to ensure a fixed rotor position. The pintle assembly is then locked from movement within the apparatus frame.

The drive pintle 15*a*, 15*b* is also retracted retaining the reverse gear set 8 in mesh. The driven pintle 15*a* is equipped with a male gear coupling hub that slides into a female hub that is stationary and secured to the output shaft of the gear motor 28. The drive remains intact. The rotor is engaged with the pintle but free to move within expansion limits. The reverse procedure can be used to install a new rotor.

Once the rotors are removed from the apparatus as shown in FIG. 2, access is available to remove the wear plates 4 that are the bulkheads on each side of the rotor assemblies. These wear plates 4 are heat treated and resist constant abrasion of the waste material during processing. The wear plates 4 also serve as a labyrinth seal to prevent waste material from entering the bearings. The end wear plates 4 are secured to the side frames 17 and when the side frames 17 are removed from the machine, the wear plates 4 are also removed.

The center wear plate 3 is ported so that waste material can be discharged to the lower hopper before it gets to the seal. The seals can also be easily replaced once the wear plates 3, 4 are removed. The seals are removed and new seals installed.

The bearings 29, 44 are part of the sliding assemblies described previously. The fact that the bearings are separated from the seals and have adequate space between these components permits seal failure without bearing failure. Therefore, the integrity of the apparatus is intact preserved from the waste material which would contaminate the machine housings. The apparatus 30 can now be serviced at proper intervals.

While the invention has been explained by a detailed description of certain specific embodiments, it is understood that various modifications and substitutions can be made in any of them within the scope of the appended claims which are intended also to include equivalents of such embodiments.

What is claimed is:

1. A comminuting apparatus for shredding waste products comprises:

an elongated frame having removable side plates;

drive means;

a drive pintle and a driven pintle coupled thereto;

means coupling said drive means to the drive pintle;

a rotor shaft having a plurality of spaced cutters and a plurality of spacers mounted thereon with each cutter separated by a spacer;

a holding fixture mountable to the frame, said side plates having been removed to provide support for sliding the rotor assembly from the frame;

and hydraulic drive means for moving the drive pintle and the driven pintle laterally to engage and disengage the pintles.

2. A comminuting apparatus for shredding waste products in accordance with claim 1 further including:

guide pins having the pintles coupled thereto to be driven axially therealong by the hydraulic drive means.

3. A comminuting apparatus for shredding waste products in accordance with claim 1 wherein:

the rotor shaft includes hexagonal end portions for engaging the pintles and further including split rotor collars having set screws for laterally adjusting the cutters and spacers to mesh properly with the cutters and spacers on an adjacent rotor shaft.

4. A comminuting apparatus for shredding waste products in accordance with claim 1 wherein:

the holding fixture comprises a pair of parallel elongated members, each having an upwardly curving top surface at each end to retain a rotor shaft on said member and a transverse member extending between said elongated members at an intermediate position thereof.

5. A comminuting apparatus for shredding waste products in accordance with claim 4 wherein:

the transverse member extends beyond the elongated members at each end and includes a downwardly extending portion for coupling to the frame after the side plates have been removed.

6. A comminuting apparatus for shredding waste products in accordance with claim 4 wherein:

the parallel elongated frame members each comprise a main body portion having a top surface and a bottom surface, said bottom surface having an upwardly tapering portion at its outer ends, and a vertical end surface connected thereto.

* * * * *